US006023846A

United States Patent [19]

Crawford et al.

[11] Patent Number: 6,023,846

[45] Date of Patent: Feb. 15, 2000

[54] PLANING TOOL FOR SMOOTHING THE EDGES OF DRYWALL PANELS

[76] Inventors: Steve Crawford, P.O. Box 258; Roger Leafgreen, 40 Sunset Dr., #1, both of Basalt, Colo. 81621

[21] Appl. No.: 09/263,536

[22] Filed: Mar. 8, 1999

[51] Int. Cl.[7] ..... B26B 3/08

[52] U.S. Cl. ..... 30/172; 15/236.01

[58] Field of Search ..... 30/169–172, 294; 15/236.01

[56] References Cited

U.S. PATENT DOCUMENTS 3,123,911 3/1964 Snyder ..... 30/172
3,762,046 10/1973 Kolomick ..... 30/172
3,990,147 11/1976 Gill et al. ..... 30/172
4,146,943 4/1979 Wertheimer et al. ..... 30/172 X

*Primary Examiner*—Douglas D. Watts
*Attorney, Agent, or Firm*—Norman B. Rainer

[57] ABSTRACT

A tool for smoothing and shaping the edges of drywall panels includes an elongated housing having a base portion and opposed side walls which define with the base portion a straight guide channel. Several cutting members are secured within the channel. Each cutting member has a circular cutting edge, and the several cutting edges are disposed in coplanar alignment parallel to the base portion. Relief passageways are formed in the sidewalls adjacent each cutting member.

12 Claims, 1 Drawing Sheet

PLANING TOOL FOR SMOOTHING THE EDGES OF DRYWALL PANELS

BACKGROUND OF THE INVENTION

1. Field of the Invention

This invention relates to the manipulation and installation of construction panels, and more particularly concerns a tool for smoothing and shaping the edge extremities of drywall panels.

2. Description of the Prior Art

"Drywall" panels employed in the construction of wood frame residential buildings are comprised of a dense central layer of gypsum sandwiched between opposed outer layers of thick paper. In use, the panels, generally available in 4 foot by 8 foot rectangular sizes, are nailed to a the upright 2" by 4" wooden studs of the framework of the building to produce a smooth wall structure, or are nailed to wooden overhead beams to provide a ceiling surface. In order to produce apparently seamless wall and ceiling surfaces, it is necessary to install adjacent panels so that the edges of the panels are in tight-fitting abutment. In the case of a standardized array of wall studs, such tight abutment is easily achieved merely by placing the as-manufactured panels in side-by-side edgewise contact. However, instances arise involving irregular wall or ceiling contours or spacings where specialized cutting and fitting of panels becomes necessary.

The selective trimming of a drywall panel is usually accomplished at the construction site by scoring one surface of the panel in a straight line, then applying shearing force to cause the panel to break along the scored line. However, the edges newly created by the breaking actions are generally of rough contour. In order to smooth the rough edges of the panel, various dressing devices have been employed, including the use of scraping devices and planes of the sort utilized in smoothing wood edges. Whereas the gypsum component of the panel is controllably removed by such tools as a dust, the paper component of the panel accumulates and fouls the tool. It is also to be noted that hand tools such as planes generally provide their shaping effect in just one direction of linear motion.

It is accordingly an object of the present invention to provide a device for smoothing the edges of a drywall panel.

It is another object of this invention to provide a device as in the foregoing object which is resistant to fouling by the paper component of said panel.

It is a further object of the present invention to provide a manually operable device of the aforesaid nature which is manually operable and easy to use and clean.

It is yet another object of this invention to provide a device of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a manually operated tool for the shaping of edges of drywall panels having a gypsum core sandwiched between opposed paper surfaces, said tool comprising:

a housing elongated upon a center axis and comprised of a base portion and paired opposed sidewalls which define with said base portion a straight guide channel having a flat bottom surface, several cutting members secured within said channel and centered upon said axis, each cutting member being of monolithic metal construction and cup-shaped configuration and comprised of:

a) a circular bottom portion having means for securement to said housing, b) a circular sidewall upwardly emergent from said bottom portion and bounded by an exterior surface and concentrically disposed interior surface, said interior and exterior surfaces terminating upwardly in a circular rim whose width is defined by the distance between said interior and exterior surfaces, and c) a circular cutting edge associated with said rim and formed by the tapering of said exterior surface inwardly and downwardly from said rim, terminating in a groove recessed within said exterior surface and surrounding said sidewall, the several cutting members being secured within said guide channel such that said circular rims are in coplanar alignment, and said recessed grooves are several millimeters above said bottom surface, and relief passageways formed in said opposed sidewalls adjacent each cutting member.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
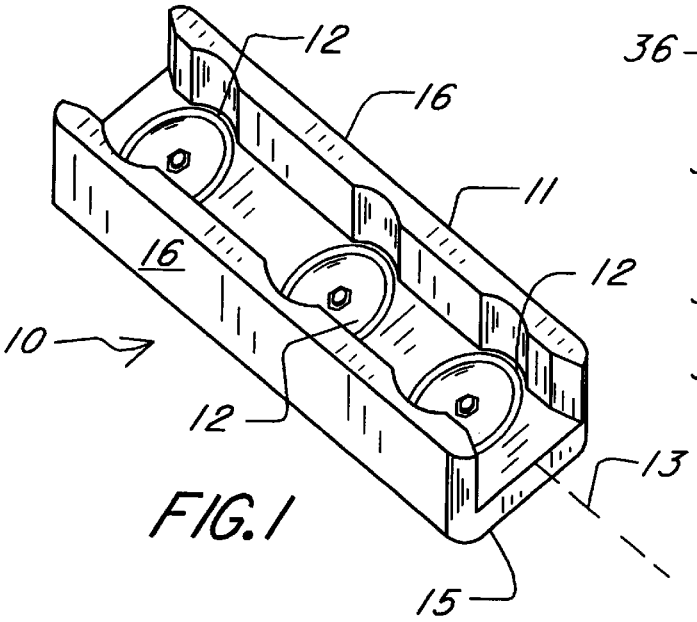
FIG. 1 is a top perspective view of an embodiment of the tool of the present invention.
Figure 2:
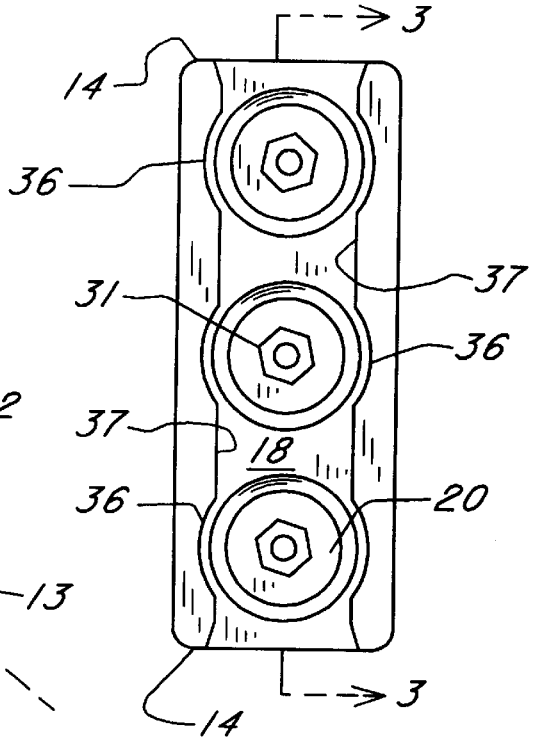
FIG. 2 is a top plan view of the tool of FIG. 1.
Figure 3:
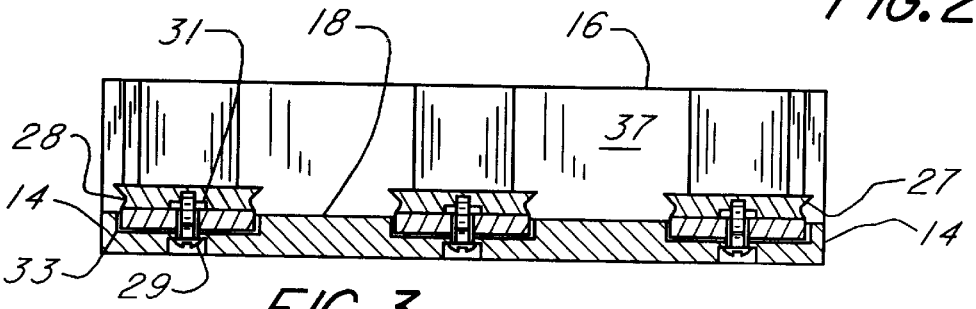
FIG. 3 is a sectional view taken in the direction of the arrows upon the line 3—3 of FIG. 2.
Figure 4:
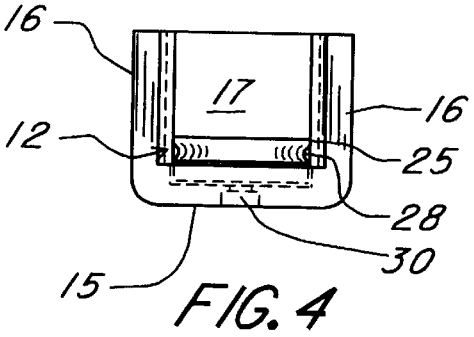
FIG. 4 is an end view.
Figure 5:
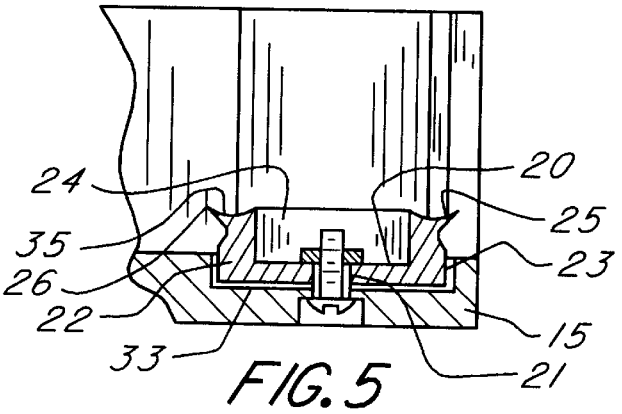
FIG. 5 is an enlarged fragmentary version of the sectional view of FIG. 3.

Referring to FIGS. 1–5, an embodiment of the planing tool 10 of the present invention is shown comprised of a housing 11 and three cutting members 12.

Housing 11, which may be fabricated of metal, wood or plastic, and preferably f monolithic construction, is elongated upon center axis 13 between opposite extremities 14. Said housing is comprised of a base portion 15 and paired opposed sidewalls 16 which define with said base portion a straight guide channel 17 having a flat bottom surface 18. The width of said channel, measured as the orthogonal distance between said sidewalls, may range between about ⅜ and ⅞ inch. The length of said channel, measured between extremities 14, may range between 4½ and 6½ inches. The thickness of said sidewalls and base portion may range between about ¼" and ½". Each extremity may be outwardly flared with respect to axis 13.

Said cutting members, which may range in number between about 2 and 5, are disposed within channel 17 and centered upon axis 13. The several cutting members are preferably identical, each being preferably of monolithic metal construction and having a cup-shaped configuration. The cutting members are further comprised of a circular bottom portion 20 having means such as centered aperture 21 to facilitate securement to base portion 15. A circular sidewall 22 is upwardly emergent from the perimeter of bottom panel 20, said sidewall 22 being bounded by exterior surface 23 and concentrically disposed interior surface 24 of circular cylindrical shape. Said interior and exterior sidewall surfaces terminate upwardly in a circular rim 25 whose width, defined by the distance between said sidewall surfaces, may range between about 2 and 5 millimeters.

A circular cutting edge 26 is associated with the outermost perimeter of rim 25, and is formed by the tapering of exterior surface 23 beginning at said rim. Such taper 27 is in a direction inwardly toward aperture 21 and downwardly toward bottom portion 20. Said taper 27 terminates in a recessed groove 28 that surrounds said sidewall. The depth of said groove may range between about 1 and 2 millimeters. The effectiveness of cutting edge 26 is enhanced by imparting to rim 25 an upwardly concave contour 35.

The several cutting members are secured within said guide channel such that the rims 25 are in coplanar alignment about ⅛" above bottom surface 18 and grooves 28 are located one to two millimeters above said bottom surface. Securement of the cutting members may be achieved employing a threaded bolt 29 which penetrates aperture 21 and aligned bore 30 in base portion 15, and is fastened by nut 31 acting against bottom portion 20. To facilitate the placement and securement of the cutting members, seating recesses 33 may be disposed in base portion 15 to receive said cutting members in tight-fitting frictional engagement.

Relief passageways 36 are formed in the interiorly facing surfaces 37 of opposed sidewalls 16 in embracing relationship with each cutting member. The exemplified passageways 36 are of arcuate contour concentric with cutting edge 26 and spaced therefrom by about 2 millimeters. The function of said passageways is to facilitate removal of paper debris derived from the shaping of an edge of a drywall panel.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described our invention, what is claimed is:

1. A manually operated tool for the shaping of edges of drywall panels having a gypsum core sandwiched between opposed paper surfaces, said tool comprising:

a) a housing elongated upon a center axis and comprised of a base portion and paired opposed sidewalls which define with said base portion a straight guide channel terminating in opposite extremities, b) several cutting members secured within said channel and centered upon said axis, each cutting member being of metal construction and comprised of:

1) a circular bottom portion having means for securement to said base portion, 2) a circular sidewall upwardly emergent from said bottom portion and bounded by an exterior surface and concentrically disposed interior surface, said interior and exterior surfaces terminating upwardly in a circular rim whose width is defined by the distance between said interior and exterior surfaces, and 3) a circular cutting edge associated with said rim, c) the several cutting members being secured within said guide channel such that said cutting edges are in coplanar alignment, and d) relief passageways formed in said opposed sidewalls adjacent each cutting member.

2. The tool of claim 1 wherein said cutting members are of monolithic construction.

3. The tool of claim 2 wherein said cutting members are of cup shaped configuration.

4. The tool of claim 1 wherein the extremities of said guide channel are outwardly flared with respect to said center axis.

5. The tool of claim 1 wherein said cutting edge is formed by the tapering of said exterior surface inwardly and downwardly from said rim.

6. The tool of claim 1 further comprising a groove recessed within the exterior surface of said circular sidewall and surrounding said sidewall.

7. The tool of claim 6 wherein said groove is formed in part by the tapering of said exterior surface inwardly and downwardly from said rim.

8. The tool of claim 1 comprised of three cutting members.

9. The tool of claim 1 wherein said securement means is a bore adapted to accommodate a threaded bolt.

10. The tool of claim 6 wherein the grooves of said cutting members are positioned one to two millimeters above said base portion.

11. The tool of claim 1 wherein said guide channel has a flat bottom surface.

12. The tool of claim 11 wherein said cutting members are secured to said flat bottom surface.

* * * * *